US010427022B2

(12) United States Patent
Shoshan et al.

(10) Patent No.: US 10,427,022 B2
(45) Date of Patent: Oct. 1, 2019

(54) STRIKING ASSEMBLY

(71) Applicant: BIG HIT HOLDINGS INC., Toronto (CA)

(72) Inventors: Asi Shoshan, Toronto (CA); Gidon Gabbay, Toronto (CA)

(73) Assignee: BIG HIT HOLDINGS INC., Toronto (CA)

( * ) Notice: Subject to any disclaimer, the term of this patent is extended or adjusted under 35 U.S.C. 154(b) by 46 days.

(21) Appl. No.: 15/877,907

(22) Filed: Jan. 23, 2018

(65) Prior Publication Data

US 2019/0224550 A1 Jul. 25, 2019

(51) Int. Cl.

| | |
|---|---|
| ***A63B 69/34*** | (2006.01) |
| ***A63B 69/20*** | (2006.01) |
| ***A63B 23/035*** | (2006.01) |
| ***A63B 69/00*** | (2006.01) |

(52) U.S. Cl.

CPC ..... *A63B 69/34* (2013.01); *A63B 23/0355* (2013.01); *A63B 69/004* (2013.01); *A63B 69/20* (2013.01); *A63B 2209/00* (2013.01)

(58) Field of Classification Search

CPC ... A63B 69/34; A63B 23/0355; A63B 69/004; A63B 2209/00; A63B 69/20–345

USPC ..... 482/83, 87

See application file for complete search history.

(56) References Cited

U.S. PATENT DOCUMENTS 615,700 A 12/1898 Hess
1,481,594 A * 1/1924 Fitzgerald ..... A63B 69/208 40/608
2,009,040 A * 7/1935 Beach ..... A63B 69/208 248/160
2,085,161 A * 6/1937 Kraus ..... A63B 69/208 248/160
2,184,453 A * 12/1939 Hayes ..... A63B 69/208 482/90
2,186,403 A * 1/1940 Bullis ..... A63B 69/208 248/160
4,387,892 A * 6/1983 Wen ..... A63B 69/34 482/83
4,662,630 A * 5/1987 Dignard ..... A63B 69/004 482/83
5,046,724 A 9/1991 Sotomayer
5,437,590 A * 8/1995 D'Alto ..... A63B 69/208 473/441
5,788,612 A * 8/1998 Rennick ..... A63B 69/208 482/83

(Continued)

*Primary Examiner* — Andrew S Lo

(74) *Attorney, Agent, or Firm* — Perry + Currier Inc.

(57) ABSTRACT

A striking assembly for martial arts training is provided. The striking assembly includes a base plate configured to be secured to the ground, a support unit having a support plate and a post extending from the support plate, and a striking unit having a main body configured to receive a portion of the post and a striking pad covering at least a portion of the main body. The support plate and the base plate are connected by three or more resiliently deformable isolators. In response to striking impacts, the isolators resiliently deform to create a deflection angle between a normal to the support plate and a normal to the base plate, and resiliently return to their undeformed dimensions at the conclusion of the striking impact such that the normal to the support plate returns to being substantially parallel to the normal to the base plate.

14 Claims, 10 Drawing Sheets

(56) References Cited

U.S. PATENT DOCUMENTS 5,899,835 A * 5/1999 Puranda ..... A63B 69/34 482/83
5,921,895 A * 7/1999 Lynch ..... A63B 69/208 482/83
5,941,801 A * 8/1999 D'Alto ..... A63B 69/208 482/83
6,003,944 A 12/1999 Glockl
6,027,435 A * 2/2000 Nadorf ..... A63B 69/208 482/146
6,176,548 B1 1/2001 Thole et al.
6,808,477 B2 10/2004 Tudor
7,244,219 B1 7/2007 Preciado
7,547,067 B2 6/2009 Keilhauer et al.
7,651,447 B2 1/2010 Yang
7,704,194 B1 * 4/2010 Chen ..... A63B 69/208 482/83
8,066,624 B1 11/2011 Stroup
8,167,743 B1 * 5/2012 Kangas ..... A63B 69/345 473/422
8,393,980 B2 3/2013 Chen
D697,157 S * 1/2014 Siklosi ..... A63B 69/004 D21/787
8,647,242 B2 2/2014 Schlicher
D706,887 S * 6/2014 Siklosi ..... A63B 69/004 D21/787
2004/0209743 A1 * 10/2004 Perez ..... A63B 69/34 482/83
2007/0249473 A1 * 10/2007 Robinson ..... A63B 69/004 482/83
2009/0264263 A1 * 10/2009 Yang ..... A63B 69/0075 482/85
2011/0275492 A1 * 11/2011 Brenner ..... A63B 69/34 482/83
2012/0214648 A1 * 8/2012 Schlicher ..... A63B 69/203 482/87
2013/0324370 A1 * 12/2013 Harrigan ..... A63B 69/34 482/84
2014/0148314 A1 * 5/2014 Schlicher ..... A63B 69/203 482/87
2014/0221129 A1 * 8/2014 Chen ..... A63B 69/208 473/422
2015/0065312 A1 * 3/2015 Harrigan ..... A63B 69/32 482/84
2016/0073786 A1 3/2016 Walker et al.
2017/0036087 A1 * 2/2017 Codrington ..... A63B 69/32

* cited by examiner

STRIKING ASSEMBLY

FIELD

The present disclosure relates generally to martial arts training devices. More particularly, the present disclosure relates to a striking assembly for martial arts training.

BACKGROUND

Martial arts are systems of combat practices and may include strikes, such as punching and kicking, as well as grappling and holds. Practitioners of the martial arts may practice striking and other movements patterns using equipment such as mats, as well as striking assemblies, or "dummies."

SUMMARY

In this specification, elements may be described as "configured to" perform one or more functions or "configured for" such functions. In general, an element that is configured to perform or configured for performing a function is enabled to perform the function, or is suitable for performing the function, or is adapted to perform the function, or is operable to perform the function, or is otherwise capable of performing the function.

According to an aspect of this disclosure, a striking assembly for martial arts training is provided. The striking assembly includes a base plate having a first side and a second side opposite the first side, the base plate configured to be secured to a substrate external to the striking assembly; a support unit comprising a support plate having a third side and a fourth side opposite the third side, the support plate coupled to the base plate and disposed such that the third side of the support plate is proximal to and faces the second side of the base plate and a post secured to the support plate, the post extending from the fourth side of the support plate in a direction away from the fourth side; a striking unit comprising a main body having a recess for receiving a portion of the post of the support unit, the main body reversibly securable to the post, and a striking pad covering at least a portion of the main body, the striking pad configured to receive striking impacts; and three or more isolators coupling the support plate to the base plate. Each isolator has a body being resiliently deformable, and a first end of each isolator is connected to the second side of the base plate, and a second end of each isolator is connected to the third side of the support plate. The three or more isolators are spaced such that one isolator is out of line with the other two isolators. The isolators are resiliently deformable in response to a force originating from the striking impacts. Specifically, in response to at least one of the striking impacts, when the force is being applied during the at least one striking impact, the isolators are configured to resiliently deform in response to the force such that the striking unit and the support unit reversibly deflect relative to the base plate to create a deflection angle between a normal to the support plate and a normal to the base plate; and when the force is discontinued at a conclusion of the at least one striking impact, the isolators are configured to resiliently return substantially to their undeformed dimensions to cause the striking unit and the support unit to rebound such that the normal to the support plate returns to being substantially parallel to the normal to the base plate.

In some implementations, each isolator may further comprise a first end member connected to the body and disposed at the first end of the isolator, and a second end member connected to the body and disposed at the second end of the isolator.

In some implementations, the first end member may comprise a first metal plate, and the second end member may comprise a second metal plate.

In some implementations, the body may comprise rubber.

In some implementations, the body of the isolator may be cylindrical in shape.

In some implementations, the striking unit and the support unit may deflect relative to the base plate to create a deflection angle of at most 20 degrees between the normal to the support plate and the normal to the base plate.

In some implementations, the base plate and the support plate may be substantially triangular, the striking assembly having three isolators, each isolator connecting a vertex of the base plate and a corresponding vertex of the support plate.

In some implementations, the striking assembly may further comprise mounting lugs extending from the base plate, each mounting lug having an aperture to receive one of the isolators to support the isolator.

In some implementations, the post may further comprise a plurality of apertures spaced along a longitudinal axis of the post; and the main body may further comprise a pin movable between a secured position wherein the pin is at least partially received in one of the plurality of apertures to secure the main body to the post, and an adjustment position, wherein the pin is removed from the apertures to allow movement of the striking unit along the longitudinal axis of the post.

In some implementations, the striking unit may further comprise a spring connected to the pin and the main body and configured to bias the pin in the secured position.

In some implementations, the striking assembly may further comprise a pneumatic piston disposed adjacent to the post and connecting the striking unit to the support unit to facilitate movement of the striking unit along the longitudinal axis of the post.

In some implementations, the post may be square shaped to limit rotational movement of the striking unit about a longitudinal axis of the post.

In some implementations, the striking assembly may further comprise gussets secured to the post and the support plate to support the post.

In some implementations, the striking pad may be positioned around the main body.

BRIEF DESCRIPTION OF DRAWINGS

Some implementations of the present specification will now be described, by way of example only, with reference to the attached Figures, wherein.

DETAILED DESCRIPTION

In martial arts training, assemblies, or "dummies" may be used to practice striking. Some bases created to hold striking assemblies include a weighted base or spring implementations to cause the striking assembly to return to an upright position after striking impacts.

Striking assemblies with a weighted base may move in between strikes, thus requiring them to be repositioned between strikes. Further, these striking assemblies have low durability for high volumes of strikes and have a large range of motion. The large range of motion causes a delay between striking impacts, as a user waits for the assembly to spring back into position. Further, a large range of motion may cause a large force on the return, potentially causing injury to the user.

Striking assemblies with spring implementations generally have a large range of motion. As with the weighted base, the large range of motion causes a delay between striking impacts, as a user waits for the assembly to spring back into position. Further, a large range of motion may cause a large force on the return, potentially causing injury to the user.

Figure 1:
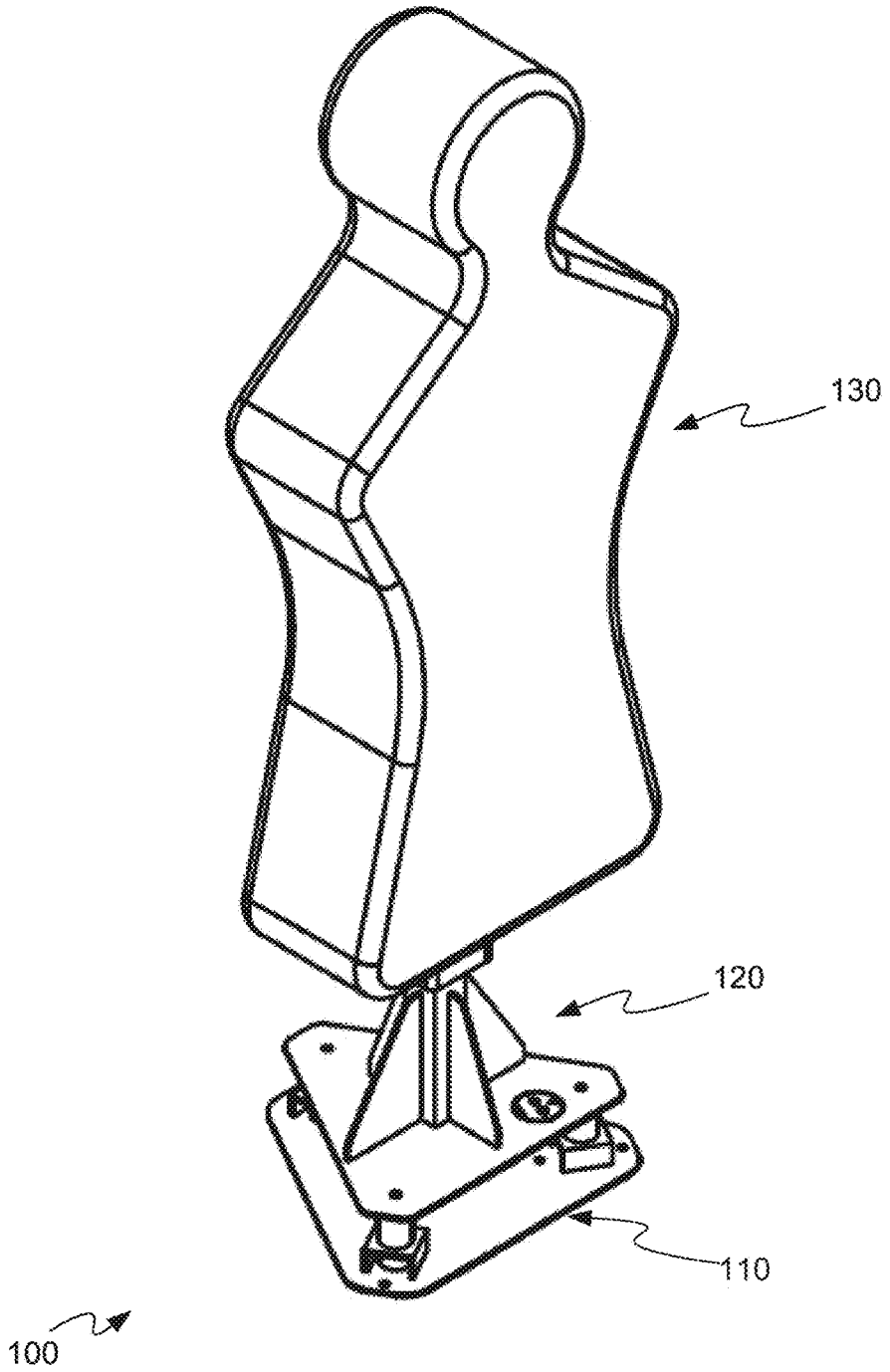
FIG. 1 shows an example striking assembly.

FIG. 1 shows a striking assembly 100. The striking assembly 100 includes a base plate 110, a support unit 120 coupled to the base plate 110, a striking unit 130 configured to be reversibly securable to the support unit 120, and isolators 140 coupling the support unit 120 to the base plate 110.

The base plate 110 has a first side and a second side opposite the first side. The base plate 110 may comprise any suitable material for providing structural support to the base plate 110. The base plate 110 may include, but is not limited to combinations of metals, plastics and the like. The base plate 110 is configured to be secured to a substrate external to the striking assembly such that the first side of the base plate 110 is proximal to the substrate. For example, the base plate 110 may be secured to a floor, a podium, the ground, or the like. The base plate 110 may be secured to the substrate by bolts, stakes, welding, or other suitable fasteners to secure the base plate 110 to the substrate.

Figure 2:
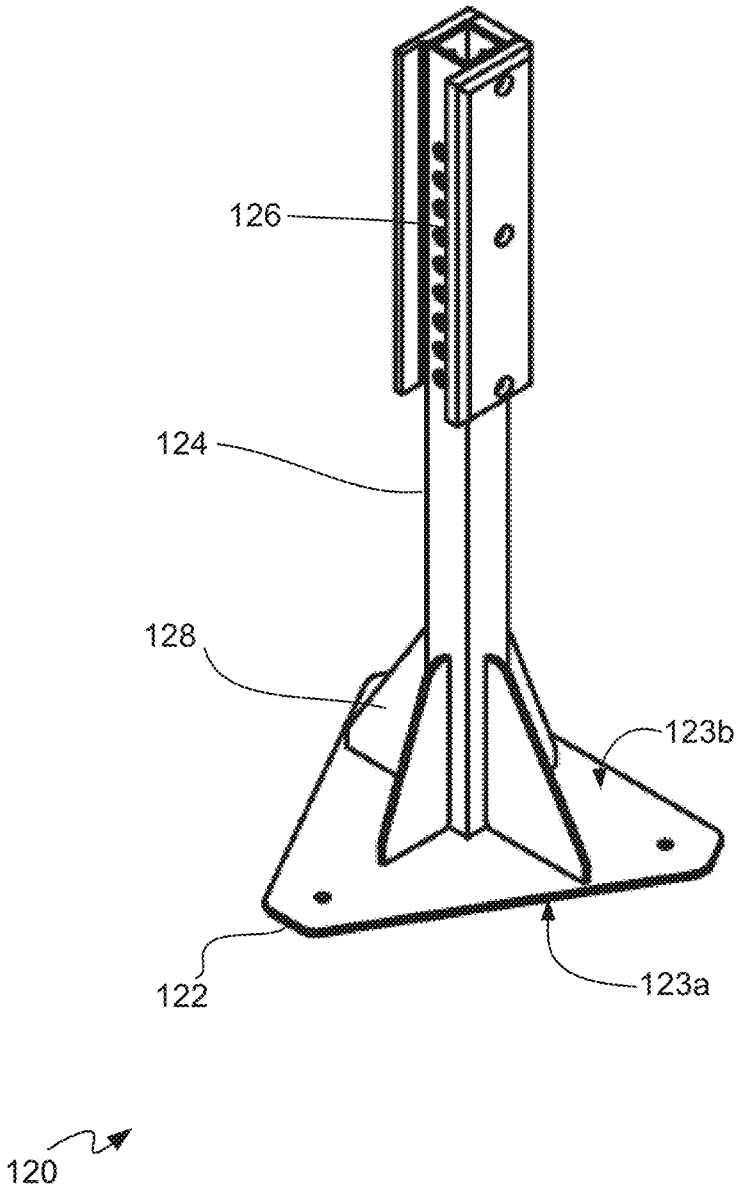
FIG. 2 shows an example support unit of the striking assembly of FIG. 1.

FIG. 2 shows the support unit 120 of the striking assembly 100.

The support unit 120 includes a support plate 122 and a post 124. The support plate 122 has a respective first side 123*a* and a second side 123*b* opposite the first side 123*a*. The support plate 122 may comprise any suitable material for providing structural support to the support plate 122. The support plate 122 may include, but is not limited to, combinations of metals, plastics and the like. The support plate 122 is coupled to the base plate 110 and disposed such that the first side 123*a* is proximal the second side of the base plate 110.

The post 124 is secured to the support plate 122, the post 124 extending from the second side 123*b* in a direction away from the first side 123*a*. The post 124 is configured to be received by the striking unit 130. The post 124 may also comprise any suitable material for providing structural support to the post 124. The post 124 may include, but is not limited to, combinations of metals, plastics and the like. The post 124 may be secured to the support plate 122 by bolts, stakes, welding or other suitable fasteners to maintain the extension of the post 124 from the support plate 122. In some implementations, the post 124 may be integral with the support plate 122. The post 124 may be hollow or filled.

In some implementations, the post 124 may be square shaped to limit rotational movement of the striking unit 130 about a longitudinal axis of the post 124. In other implementations, the post 124 may be triangular, hexagonal, or otherwise shaped to limit rotational movement of the striking unit 130 about the longitudinal axis of the post 124.

In other implementations, the support unit 120 may further comprise gussets 128 secured to the post 124 and the support plate 122, the gussets 128 configured to support the post 124. For example, the support unit 120 may comprise four gussets 128, each secured to a side of the square post 124 and to the support plate 122. Thus, the gussets 128 may be substantially triangular in shape. Gussets 128 may comprise any suitable material for providing structural support to the gussets 128. The gussets 128 may include, but are not limited to, combinations of metals, plastics and the like. The gussets 128 may be secured to the post 124 and the support plate 122 by bolts, stakes, welding or other suitable fasteners. In some implementations, the gussets may be integral with the post 124. In other implementations, the gussets may be integral with the post 124 and the support plate 122.

The post 124 may further comprise a plurality of apertures 126 spaced along the longitudinal axis of the post 124 for maintaining the striking unit 130 at a height of the post 124, as will be further described herein.

In some implementations, the support plate 122 and the base plate 110 are substantially triangular. In other implementations, the support plate 122 and the base plate 110 are substantially circular. In some implementations, the support plate 122 and the base plate 110 may be similarly shaped and similarly sized. Other shapes for the support plate 122 and the base plate 110 are also contemplated.

Figure 3:
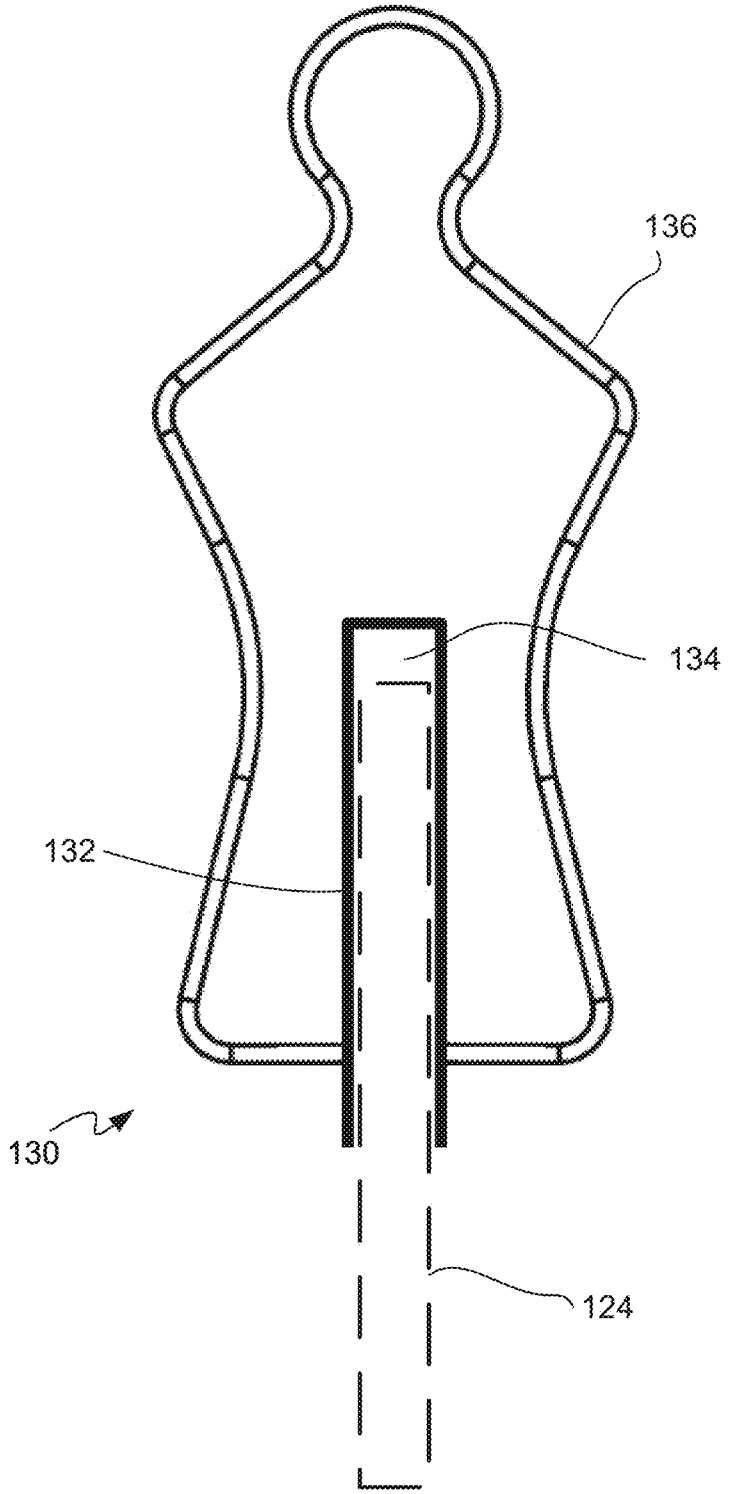
FIG. 3 shows a cross section of an example striking unit of the striking assembly of FIG. 1.

FIG. 3 shows a cross section of the striking unit 130. The striking unit 130 includes a main body 132, and a striking pad 136 covering at least a portion of the main body 132, the striking pad 136 configured to receive striking impacts.

The main body 132 has a recess 134 for receiving a portion of the post 124 of the support unit. The main body 132 may comprise any suitable material for providing structural support to the main body 132. For example, the main body 132 may include, but is not limited to, combinations of metals, plastics or the like. In some implementations, the recess 134 of the main body 132 is square shaped to be complementary to the post 124 to limit rotational movement of the striking unit 130 about the longitudinal axis of the post 124.

The striking pad 136 generally covers at least a portion of the main body 132 and is configured to receive striking impacts. In some implementations, the striking pad 136 may be positioned around the main body 132 such that the striking pad 136 covers the entirety of the main body 132. The striking pad 136 can comprise any suitable material for reversibly deforming in response to the striking impacts. For example, the striking pad 136 can include one of or combinations of foam, rubber, and the like. The striking pad 136 may be cylindrical, rectangular or otherwise shaped to receive striking impacts. In some implementations, the striking pad 136 may be shaped to resemble a human torso. Other shapes of the striking pad 136 are also contemplated.

Figure 4:
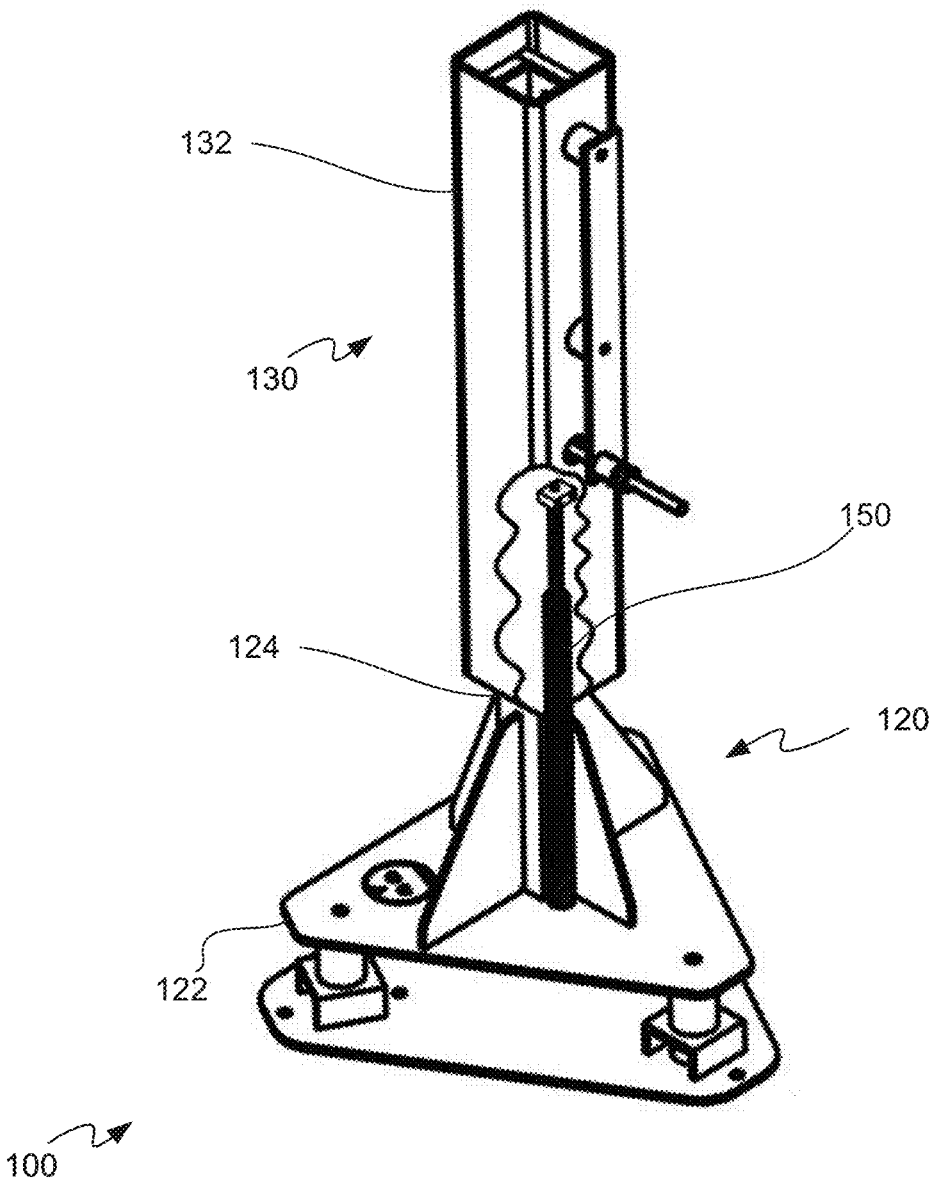
FIG. 4 shows an example pneumatic piston of the striking assembly of FIG. 1.

FIG. 4 shows the striking assembly 100, further including a pneumatic piston 150. In FIG. 4, the striking pad of the striking unit 130 is omitted, and the main body 132 is shown with a partial cutaway view. The pneumatic piston 150 connects the striking unit 130 to the support unit 120 at the support plate 122 to facilitate movement of the striking unit 130 along the longitudinal axis of the post 124. In some implementations, the pneumatic piston 150 may be disposed adjacent to the post 124, while in other implementations, the pneumatic piston 150 may be disposed in the post 124. In some implementations, the pneumatic piston 150 is reversibly secured to the support plate 122 and the striking unit 130. For example, the pneumatic piston 150 may comprise threaded ends compatible with respective threaded apertures in the support plate 122 and the striking unit 130 to allow the pneumatic piston to be screwed into position. In other examples, the pneumatic piston may be secured to the support plate 122 and the striking unit 130 by bolts, screws, welding, or other suitable fasteners to connect the pneumatic piston 150 to the striking unit and to the support unit 120 at the support plate 122.

The pneumatic piston 150 may assist in supporting the striking unit 130, in particular when the striking unit 130 is being moved along the longitudinal axis of the post 124. According to one implementation, the pneumatic piston 150 may have a pressure rating of about 50 PSI (pounds per square inch). In other implementations, the pneumatic piston 150 may have a pressure rating in a range of about 25 PSI to about 75 PSI. For example, the pressure rating of the pneumatic piston 150 may be varied based on the weight of the striking unit 130.

Figure 5:
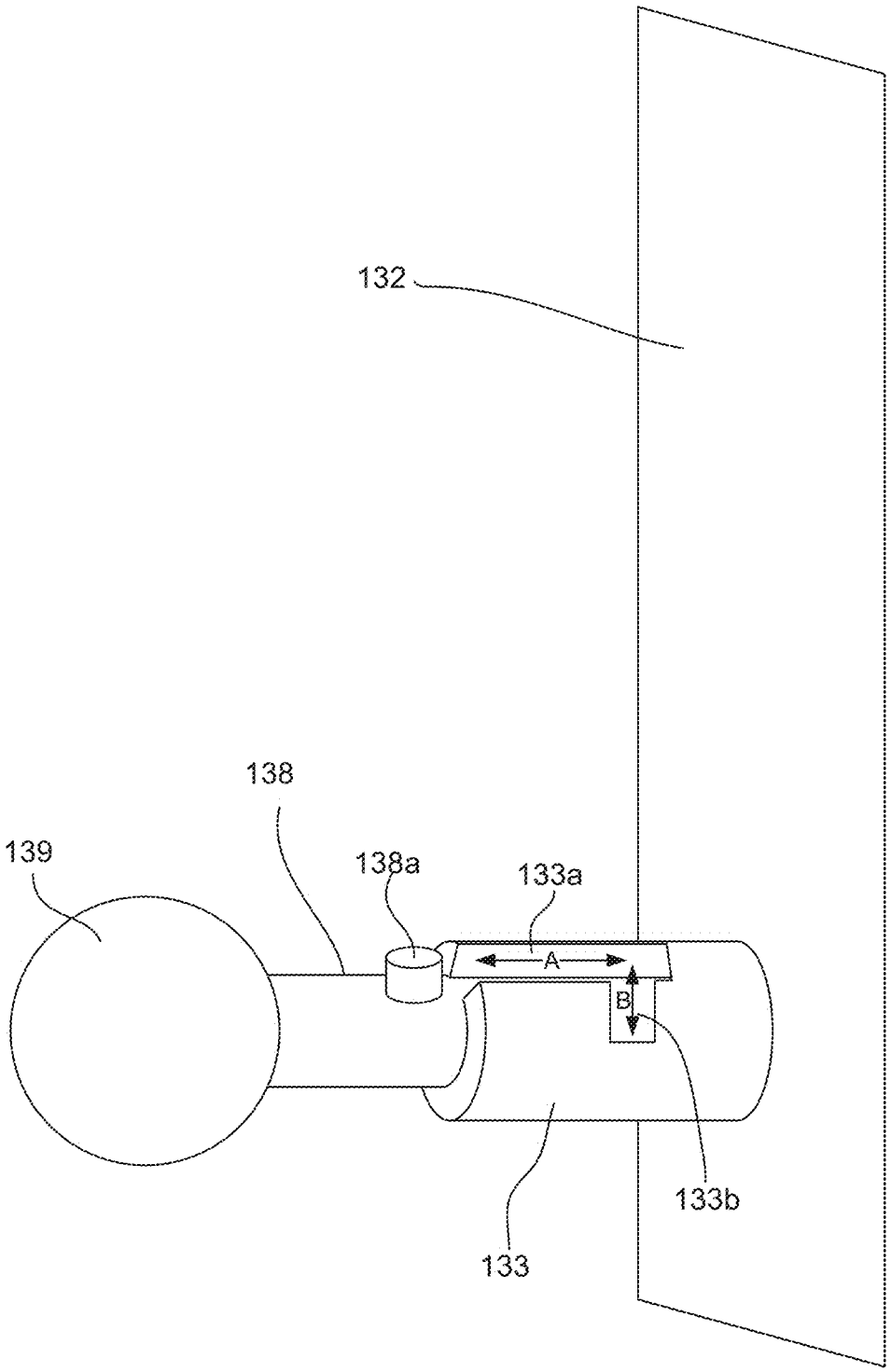
FIG. 5 shows an example pin of the striking assembly of FIG. 1 in an adjustable position.

Referring now to FIG. 5, the main body 132 is configured to be reversibly securable to the post 124. In some implementations, the main body 132 further comprises a pin 138 movable between a secured position wherein the pin 138 is configured to be received in one of the plurality of apertures 126 of the post 124 to secure the main body 132 to the post 124, and an adjustment position, wherein the pin 138 is removed from the apertures 126 to allow movement of the striking unit 130 along the longitudinal axis of the post. Thus, for example, where the longitudinal axis of the post 124 represents a height, a user may move the pin 138 from the secured position in a first aperture to the adjustment position, move the striking unit 130 to a desired height along the post 124, and then move the pin 138 back to the secured position in a second aperture to secure the main body 132 to the post 124 at the desired height.

In some implementations, the pin 138 may further comprise a handle portion 139 extending from the pin 138 in a direction away from the main body 132. The handle portion 139 may be shaped to receive one or more fingers and/or a hand of a user, or it may be a knob, or a flange, or otherwise suitably configured to allow a user to manipulate the pin 138.

The pin 138 may further comprise a locking mechanism to maintain the pin 138 in the secured position when the striking assembly 100 receives a striking impact.

In some implementations, the locking mechanism may comprise a spring connecting the pin 138 and the main body 132 and configured to bias the pin 138 in the secured position.

Figure 6:
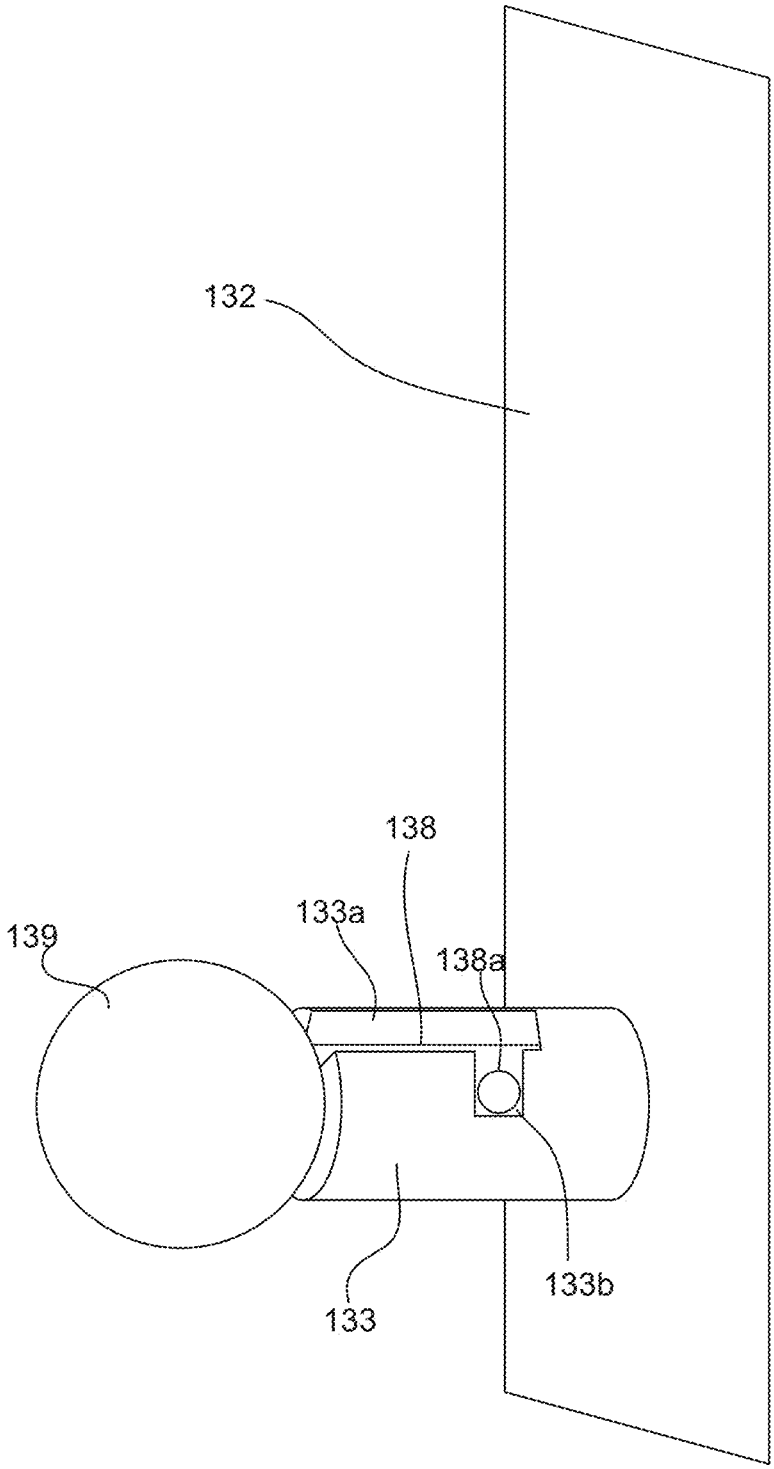
FIG. 6 shows the pin of FIG. 5 in a secured position.

Attention is now directed to FIGS. 5 and 6 which depict the pin 138 and the locking mechanism in the adjustable position and the secured position respectively.

The main body 132 has a hole (not shown) through the main body 132 for aligning the pin 138 with the apertures 126 of the post 124. The main body 132 also has a tubular extension 133 extending from the hole, perpendicular to a longitudinal axis of the main body 132, the tubular extension 133 for supporting the pin 138 in the hole of the main body 132. The tubular extension 133 has a recess having a main portion 133*a* and a side portion 133*b*. The pin 138 has a protrusion 138*a* which interacts with the recess to maintain the pin 138 in the secured position. Specifically, the recess is shaped to receive the protrusion 138*a* of the pin 138 such that the main portion 133*a* allows movement of the protrusion 138*a* in a first direction and the side portion 133*b* allows movement of the protrusion 138*a* in a second direction. For example, the main portion and the side portion may form an L-shape.

Thus, in FIG. 5, the pin 138 is shown in the adjustable position, wherein the protrusion 138*a* is removed from the recess of the tubular extension 133, and the pin 138 is removed from any of the apertures 126. The protrusion 138*a* may move in the first direction A along the main portion 133*a* when moving from the secured position to the adjustable position or from the adjustable position to the secured position. As the protrusion 138*a* moves into the recess towards an end of the recess, the pin 138 is received in one of the apertures 126 of the post 124. Hence, in some implementations, when the protrusion 138*a* is at an end of the recess, the pin 138 may be in the secured position within one of the apertures 126.

In some implementations, when the protrusion 138*a* is aligned with the side portion 133*b*, the protrusion may move in the second direction B along the side portion 133*b* via rotation of the pin 138 to the secured position depicted in FIG. 6. When the protrusion 138*b* is in the side portion 133*b*, its movement in the first direction A is limited by the side portion 133*b*, thus the pin 138 is maintained in the secured position.

Thus, to move the pin 138 from the adjustable position shown in FIG. 5 to the secured position shown in FIG. 6, the user inserts the pin 138 through the tubular extension 133 and the hole of the main body 132. The protrusion 138*a* is aligned with and moves along the main portion 133*a* in the first direction as the pin 138 is received in an aperture 126 of the post 124. Then, the pin 138 is rotatable, for example by a human user, so that the protrusion 138*a* moves along the side portion 133*b* in the second direction. Since the recess is shaped such that the protrusion cannot move in the first direction while it is in the side portion, the pin 138 is maintained in the secured position.

In still further implementations, the locking mechanism may comprise other suitable mechanisms or combinations of locking mechanisms for maintaining the pin 138 in the secured position, as will be apparent to a person of skill in the art.

Figure 7:
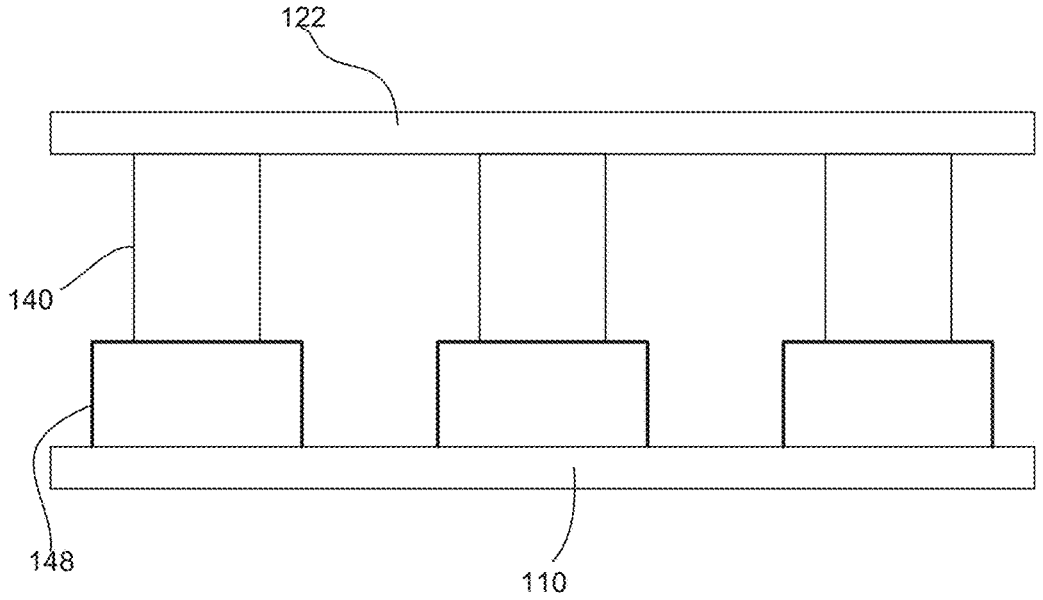
FIG. 7 shows a side view of example isolators of the striking assembly of FIG. 1 connecting a base plate to a support plate.

FIG. 7 depicts a side view of the base plate 110, the support plate 122, and the isolators 140 connecting the base plate 110 to the support plate 122.

The striking assembly 100 includes three or more isolators 140 coupling the support plate 122 to the base plate 110. The three or more isolators 140 are spaced such that one isolator 140 is out of line with the other two isolators 140. Hence, the three or more isolators 140 define a plane to support the support unit 120 via the support plate 122.

In some implementations, the striking assembly may further comprise mounting lugs 148 extending from the base plate. The mounting lugs 148 have apertures to receive the body 142 of the isolators 140 to support the isolators. The apertures may thus be shaped to complement the body 142 such that the mounting lugs 148 limit the deformation of the isolators 140.

In some implementations, the support plate 122 and the base plate 110 are substantially triangular. Thus, the striking assembly 100 may have three isolators 140, each isolator connecting a vertex of the base plate 110 to a corresponding vertex of the support plate 122. In other implementations, the support plate 122 and the base plate 110 are substantially circular. Thus, the striking assembly 100 may have three isolators 140 spaced in a substantially triangular formation around the support plate 122 and the base plate 110. Alternately, the striking assembly 100 may have more than three isolators spaced substantially evenly around circumferences of the support plate 122 and the base plate 110.

Figure 8:
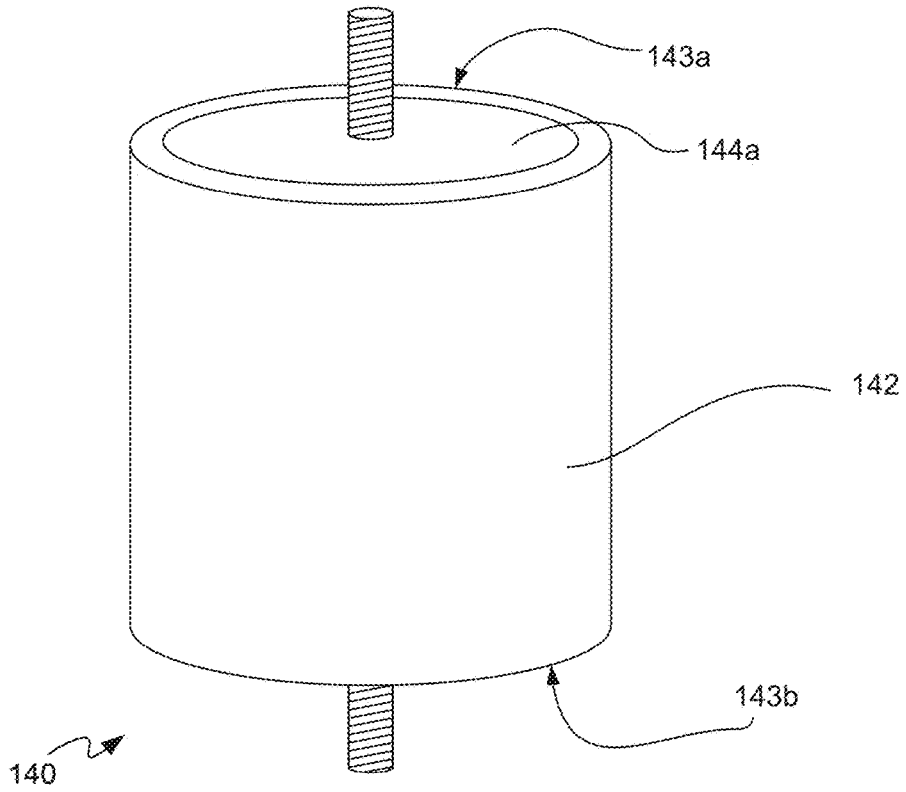
FIG. 8 shows one of the isolators of FIG. 7.

Attention is now directed to FIG. 8, which depicts an isolator 140. Each isolator 140 includes a body 142 being resiliently deformable. The isolators 140 are configured to provide an interface between the base plate 110 and the support plate 122 to dampen energy, for example vibrations, between them. Specifically, the isolators 140 are configured to allow the support plate 122, and consequently the support unit 120 and the striking unit 130 some movement, while dampening the energy to allow the base plate 110 to be securely maintained against the external substrate. The relative motion between the base plate 110 and the support plate 122 is accommodated by deformations in the body 142, rather than shear or friction at the interfaces with the base plate 110 and the support plate 122. For example, the isolators 140 may be a sandwich mount, a bushing isolator, or the like.

In some implementations, the body 142 of the isolator 140 may comprise rubber. In other implementations, the body 142 may comprise another material suitably configured to reversibly deform, such as a silicone rubber or other type of elastomeric material. In some implementations, the body 142 may be a solid cylinder, or the body 142 may be an annular cylinder to accommodate an internal structure to limit the compression of the body 142. In other implementations the body 142 may be square-shaped, oval-shaped, or have another suitable shape.

The nature of the deformation of the isolators 140 may vary depending on the direction of the force generated by a striking impact. For example, suppose the striking assembly 100 has three isolators 140 configured with two isolators at a front of the striking assembly, and one isolator 140 at a back of the striking assembly. In a direct strike to the front of the striking assembly 100, the isolator 140 at the back may compress in the body 142. For example, where the body 142 is an annular rubber cylinder, the rubber may compress to a certain extent, and any further compression may be accommodated by the annular cylinder bulging outward and/or collapsing inward at or near a center of the isolator, with the deformation in shape accommodated by the material properties of the rubber. In contrast, the isolators 140 at the front of the striking assembly may be stretched. Thus the body 142 may extend along the longitudinal axis of the isolators 140, with the extension accommodated by the material properties of the body 142. In some examples, the isolators 140 may also accommodate lateral force. Thus, a front portion of the body 142 may extend further than a rear portion of the body 142 to accommodate a bending motion.

Each isolator 140 further has a first end 143*a* and a second end 143*b* defining a longitudinal axis running through the first end 143*a* and the second end 143*b*. The first end 143*a* is configured to be connected to the second side of the base plate, and the second end 143*b* is configured to be connected to the first side 123*a* of the support plate 122.

In some implementations, each isolator 140 further includes a first end member 144*a* connected to the body 142 and disposed at the first end 143*a*, and a second end member (not shown) connected to the body 142 and disposed at the second end 143*b*. The first end member 144*a* may be a first metal plate, and the second end member may be a second metal plate. In some implementations, the metal plates may have screws extending away from the body 142 for connecting the isolators 140 to the base plate 110 and the support plate 122. In other implementations, the metal plates may form a flange with respect to the body 142 for connecting the isolators 140 to the base plate 110 and the support plate 122. In further implementations, the end members 144*a* and may comprise material other than metal, such that the end members 144*a* and are suitably configured to connect the isolators 140 to the base plate 110 and the support plate 122, as will be apparent to persons of skill in the art.

Figure 9:
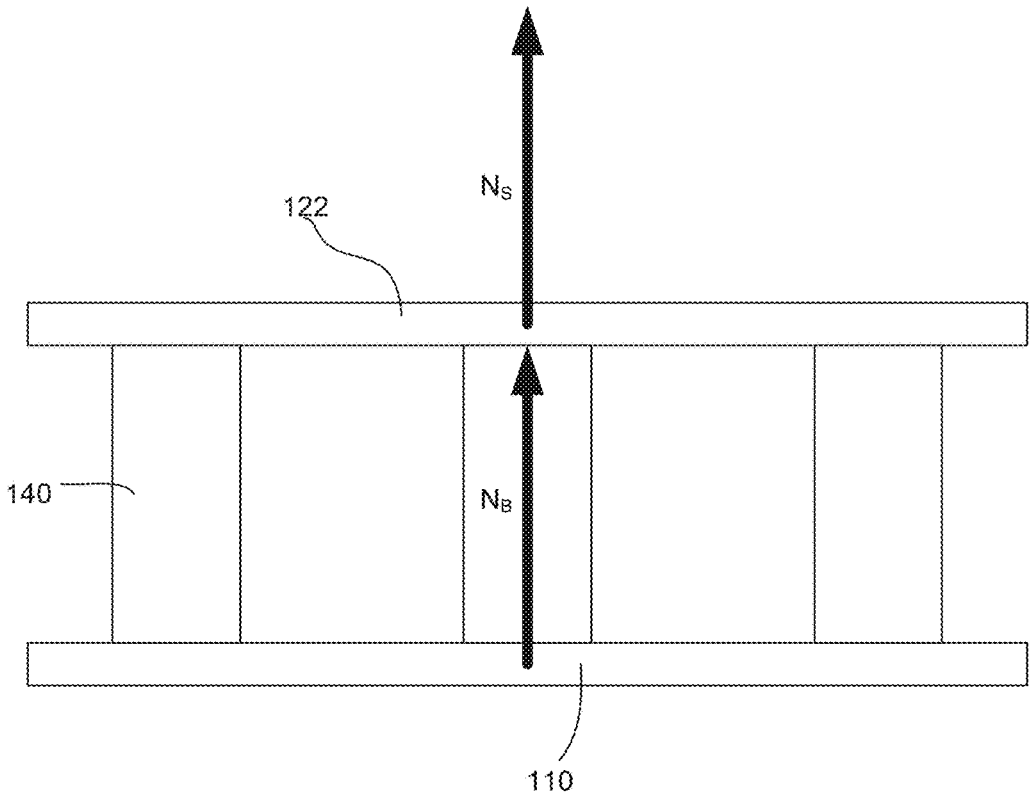
FIG. 9 shows the base plate, support plate and isolators of FIG. 7 unaffected by any striking impacts.

FIG. 9 shows a schematic side elevation view of the base plate 110, the isolators 140 and the support plate 122 unaffected by any striking impacts, with the rest of the support unit 120 and the striking unit 130 omitted for illustrative purposes. FIG. 9 shows a normal to the support plate $N_S$ and a normal to the base plate $N_B$ prior to any striking impacts. The normal to the support plate $N_S$ and the normal to the base plate $N_B$ are parallel or substantially parallel.

Figure 10:
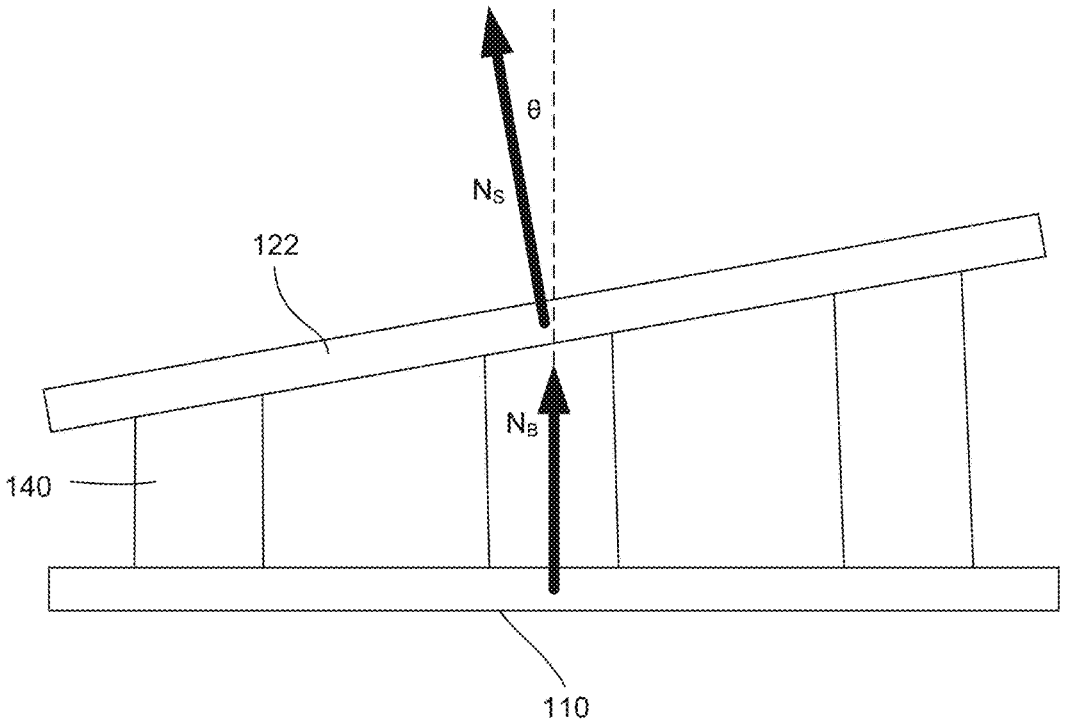
FIG. 10 shows the base plate, support plate and isolators of FIG. 7 during a striking impact.

FIG. 10 shows a schematic the base plate 110, the isolators 140 and the support plate 122 during a striking impact, with the rest of the support unit 120 and the striking unit 130 omitted for illustrative purposes. The isolators 140 are resiliently deformable in response to a force originating from striking impacts to the striking assembly. In response to at least one of the striking impacts, when the force is being applied during the at least one striking impact, the isolators 140 are configured to resiliently deform in response to the force. Specifically, the striking unit 130 and the support unit 120 reversibly deflect relative to the base plate 110 to create a deflection angle θ between the normal to the support plate $N_S$ and the normal to the base plate $N_B$.

In some implementations, the maximum deflection angle θ which is created between the normal to the support plate $N_S$ and the normal to the base plate $N_B$ may be about 20°. Thus, the support unit 120 and the striking unit 130 may deflect to create a deflection angle of at most 20°. The composition of the isolators 140 may be varied to increase or decrease the capacity of the isolators to resiliently deform. Alternately, the diameter or width of the isolators 140 may be varied to increase or decrease the capacity of the isolators to resiliently deform. Specifically, the composition or size of the isolators 140 may be varied based on an average expected force originating from striking impacts and based on the weight of the striking unit 130 and the support unit 120.

When the force is discontinued at the conclusion of the at least one striking impact, the isolators 140 are configured to resiliently return substantially to their undeformed dimensions to cause the striking unit 130 and the support unit 120 to rebound such that the normal to the support plate $N_S$ returns to being substantially parallel to the normal to the base plate $N_B$. Hence, the support plate 122 returns to also be substantially parallel to the base plate 110, as seen in FIG. 9.

Persons skilled in the art will appreciate that there are yet more alternative implementations and modifications possible, and that the above examples are only illustrations of one or more implementations. The scope, therefore, is only to be limited by the claims appended hereto.

The invention claimed is:

1. A striking assembly for martial arts training comprising:

a base plate having a first side and a second side opposite the first side, the base plate configured to be secured to a substrate external to the striking assembly;

a support unit comprising:

a support plate having a third side and a fourth side opposite the third side, the support plate coupled to the base plate and disposed such that the third side of the support plate is proximal to and faces the second side of the base plate; and a post secured to the support plate, the post extending from the fourth side of the support plate in a direction away from the fourth side;

a striking unit comprising a main body having a recess for receiving a portion of the post of the support unit, the main body reversibly securable to the post, and a striking pad covering at least a portion of the main body, the striking pad configured to receive striking impacts;

three or more isolators coupling the support plate to the base plate, each isolator having a body being resiliently deformable, a first end of each isolator connected to the second side of the base plate, and a second end of each isolator connected to the third side of the support plate, the three or more isolators spaced such that one isolator is out of line with the other two isolators, the isolators resiliently deformable in response to a force originating from the striking impacts;

wherein in response to at least one of the striking impacts:

when the force is being applied during the at least one striking impact, the isolators are configured to resiliently deform in response to the force such that the striking unit and the support unit reversibly deflect relative to the base plate to create a deflection angle between a normal to the support plate and a normal to the base plate; and when the force is discontinued at a conclusion of the at least one striking impact, the isolators are configured to resiliently return substantially to their undeformed dimensions to cause the striking unit and the support unit to rebound such that the normal to the support plate returns to being substantially parallel to the normal to the base plate.

2. The striking assembly of claim 1 wherein each isolator further comprises a first end member connected to the body and disposed at the first end of the isolator, and a second end member connected to the body and disposed at the second end of the isolator.

3. The striking assembly of claim 2 wherein the first end member comprises a first metal plate and the second end member comprises a second metal plate.

4. The striking assembly of claim 1 wherein the body comprises rubber.

5. The striking assembly of claim 1 wherein the body of the isolator is cylindrical in shape.

6. The striking assembly of claim 1 wherein the striking unit and the support unit deflect relative to the base plate to create an angle of at most 20 degrees between the normal to the support plate and the normal to the base plate.

7. The striking assembly of claim 1 wherein the base plate and the support plate are substantially triangular, the striking assembly having three isolators, each isolator connecting a vertex of the base plate and a corresponding vertex of the support plate.

8. The striking assembly of claim 1 further comprising mounting lugs extending from the base plate, each mounting lug having an aperture to receive one of the isolators to support the isolator.

9. The striking assembly of claim 1 wherein the post further comprises a plurality of apertures spaced along a longitudinal axis of the post; and the main body further comprises a pin movable between a secured position wherein the pin is at least partially received in one of the plurality of apertures to secure the main body to the post, and an adjustment position, wherein the pin is removed from the apertures to allow movement of the striking unit along the longitudinal axis of the post.

10. The striking assembly of claim 9, wherein the striking unit further comprises a spring connected to the pin and the main body and configured to bias the pin in the secured position.

11. The striking assembly of claim 9, further comprising a pneumatic piston disposed adjacent to the post and connecting the striking unit to the support unit to facilitate movement of the striking unit along the longitudinal axis of the post.

12. The striking assembly of claim 1, wherein the post is square shaped to limit rotational movement of the striking unit about a longitudinal axis of the post.

13. The striking assembly of claim 1, further comprising gussets secured to the post and the support plate to support the post.

14. The striking assembly of claim 1, wherein the striking pad is positioned around the main body.

* * * * *